United States Patent [19]

Dalsin et al.

[11] 4,020,754

[45] May 3, 1977

[54] CAP-TYPE FLUE DAMPER

[75] Inventors: Bernard L. Dalsin, Edina; George J. Dalsin; Lawrence T. Schwaab, both of Minneapolis, all of Minn.

[73] Assignee: Bernard L. Dalsin Co., Minneapolis, Minn.

[22] Filed: June 4, 1975

[21] Appl. No.: 583,841

[52] U.S. Cl. ..... 98/59; 98/85; 126/286

[51] Int. Cl.[2] ..... F23L 17/10

[58] Field of Search ..... 98/59, 85, 122; 49/322, 49/379; 126/286

[56] References Cited

UNITED STATES PATENTS

| | | | |
|---|---|---|---|
| 13,239 | 5/1911 | Lindemeyer | 98/85 |
| 700,568 | 5/1902 | Schwartz | 98/85 |
| 1,469,011 | 9/1923 | Heath | 98/85 |
| 1,544,558 | 7/1925 | Coleman | 49/322 |
| 2,704,502 | 3/1955 | Rainey | 98/59 |
| 3,101,039 | 8/1963 | Duchene et al. | 98/59 |
| 3,267,832 | 8/1966 | Hinkle | 98/59 |

*Primary Examiner*—John J. Camby
*Assistant Examiner*—Larry I. Schwartz
*Attorney, Agent, or Firm*—Warren A. Sturm

[57] ABSTRACT

A cap-type flue damper mountable in the flue opening, the cap position relative to the flue opening being controllable from controls located at the hearth, the damper having a built-in brake which prevents the cap from closing in the event of a malfunction in the spring urging the cap in the open position.

10 Claims, 7 Drawing Figures

CAP-TYPE FLUE DAMPER

BACKGROUND OF THE INVENTION

This invention relates to a fireplace damper, and particularly to an improvement in the hearth operable cap-type damper described in abandoned non-copending application U.S. Ser. No. 97,766.

The fireplace, while a highly desirable feature to the home, has become far less attractive owing particularly to the significant heat loss which it allows. Given the high cost of home heating fuel, this represents a significant disadvantage. This is perhaps the current major problem with fireplaces, although many of the time-honored drawbacks to conventionally equipped fireplaces remain, including the intrusion of rain, snow, birds, bats, squirrels, insects, and howling winds via the chimney flue. While many attempts have been made to alleviate these problems, the solutions have not always been satisfactory or have led to additional problems. Of particular concern is the safety hazard which is created if the damper fails, closing the flue without warning.

It of the object of this invention to provide a flue damper which significantly reduces heat loss and minimizes or prevents many of the other problems attendant with fireplaces. Another object is to provide such a damper which is failsafe, i.e., if a malfunction occurs, the damper will assume or maintain an open position. Still another object is a flue damper which is easy to install on existing or new chimneys, and is readily controllable at the hearth.

STATEMENT OF THE INVENTION

These and other objects are accomplished in the present invention by a flue damper assembly comprising: (1) mounting means adjustably positionable across the flue opening; (2) a downwardly extending lifting element arranged for sliding vertical movement; (3) closure cap means of a size sufficient to cover said flue opening, said closure cap being mounted on the upper end of said lifting element, said closure cap including a weather-resistant upper surface and a release under surface; (4) biasing means operatively associated with said lifting element normally urging said closure cap means into open position; (5) braking means operable in response to a malfunction in said biasing means to stop said lifting element from dropping to close said closure cap on said flue opening; and (6) hearth-located control means operatively connected to said biasing means for remotely controlling the position of said closure cap relative to said flue opening.

DESCRIPTION OF THE INVENTION

Figure 1:
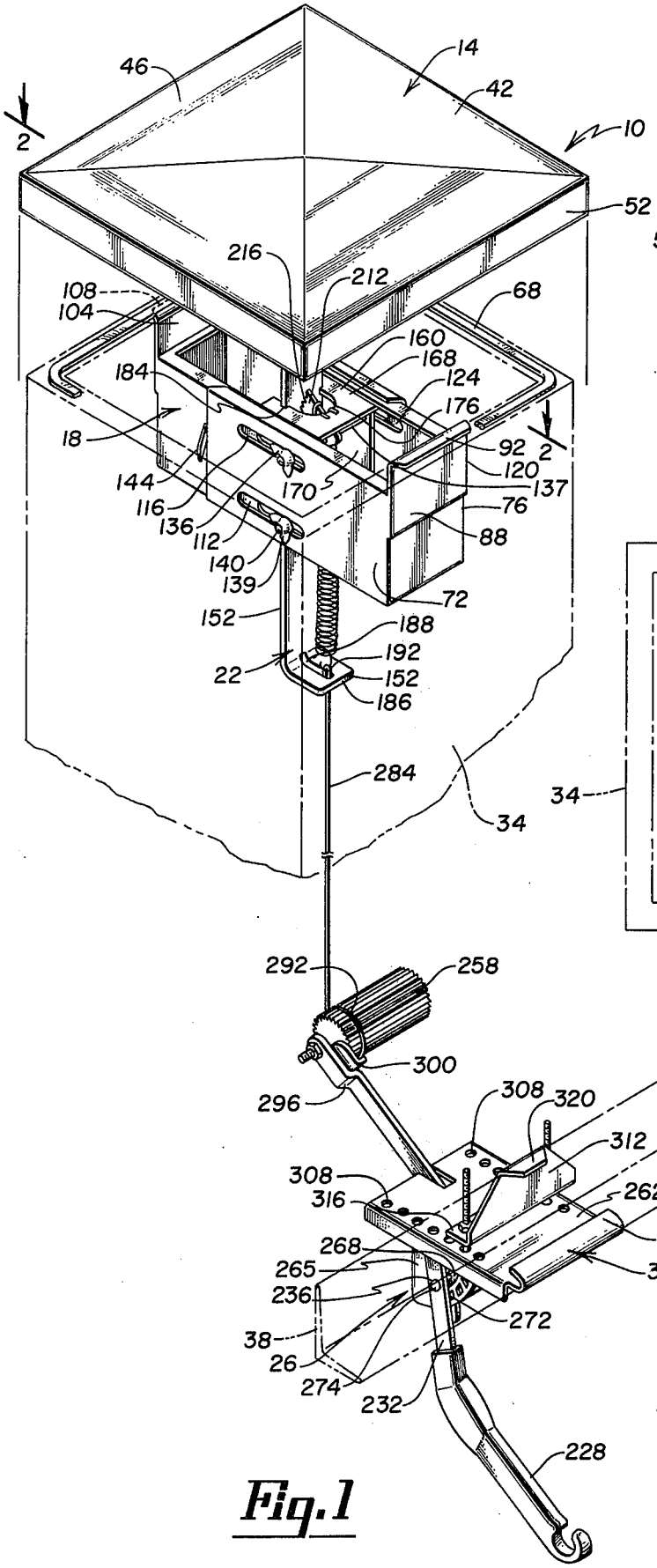
FIG. 1 is a pictorial drawing of the damper assembly of the invention.

Referring to FIG. 1, flue damper unit 10 includes a cover assembly 14, upper mounting assembly 18, lift assembly 22, actuating assembly 26, and hearth mounting assembly 30. Also depicted in FIG. 1 is a portion of a chimney 34 and a fireplace hearth angle 38 to illustrate mounting of flue damper unit 10.

Figure 7:
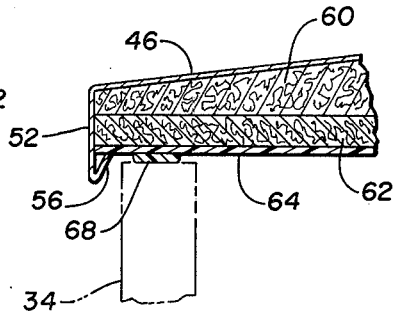
FIG. 7 is a sectional view in elevation of the closure cap in the closed position.
Figure 4:
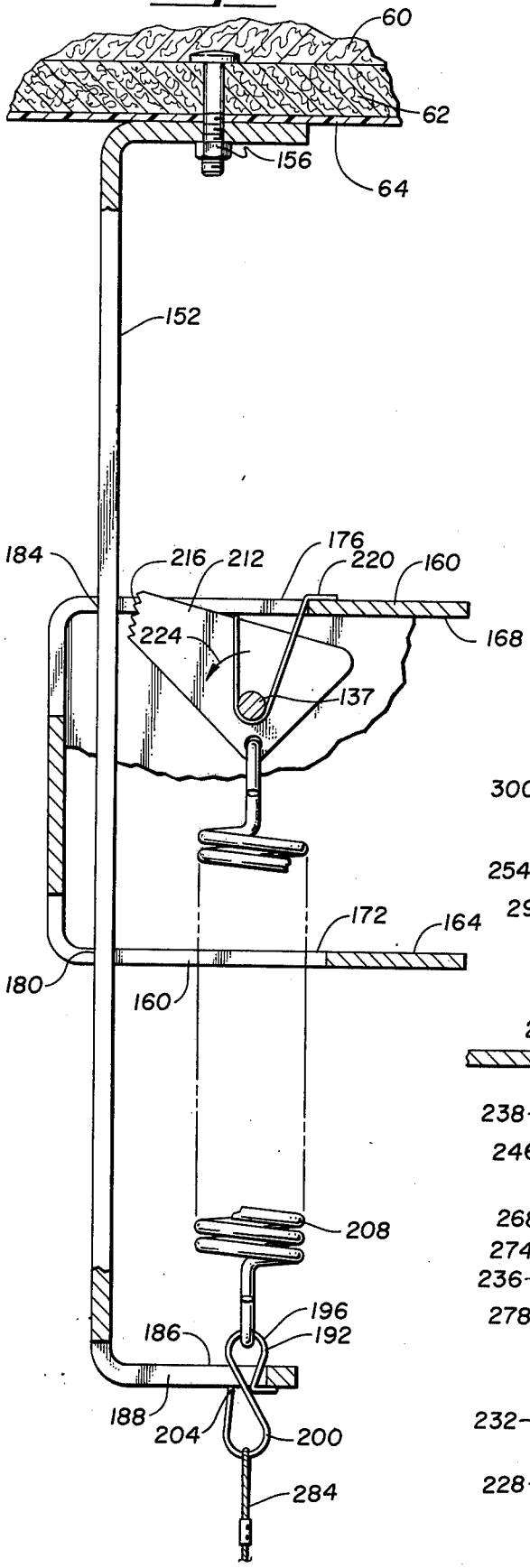
FIG. 4 is an elevational detail view of the flue assembly.

Referring to FIGS. 1, 4, and 7 for the details of the cover assembly 14, such assembly includes an outer damper lid or cap 42 having a top 46, side walls 52, and inwardly and upwardly projecting lip 56. Lid 42 is dimensioned to cover the chimney flue opening. Top 46 is peaked at the center with sloping sides to allow snow and rain to run off. Lid 42, as well as all outer parts of the assembly which are to be exposed to extreme temperatures and moisture, is made of a moisture- and temperature-resistant material. Located beneath top 46 is a bat 60 of thermal insulating material such as fiberglass. Below bat 60 is a layer 62 of a more rigid, higher heat-resistant, relatively firm material such as asbestos board. The underside of layer 62 is covered with a relatively thick sheet 64 of polyethylene.

Laid around the upper edge of chimney 34 is a sealant or gasket 68 in the form of a bead. Sealant 68 is a polymeric, heat- and weather-resistant material such as silicone rubber. As initially applied, sealant 68 is in a pliable, deformable state which in time, generally within a few days, cures or hardens to a relatively rigid, rubber-like state. While sealant 68 is in its deformable or uncured state, cover assembly 14 is lowered into its flue covering position such that it bears on the sealant 68 causing the sealant to intimately conform to the surface of sheet 64 in contact therewith. The sealant 68 is then allowed to cure or harden in contact with sheet 64 to provide a form-fitting thermal seal or gasket between the top of the chimney and the cover assembly 14. Sheet 64 is composed of a release material which will not adhere or stick to the sealant 68, allowing the cover assembly 14 to be releasably lowered onto the sealant 68 during cure to provide the desired form-fitting seal. The sealant 68 should be permitted to cure or harden before a fire is burned in the hearth if sheet 64 is made of a material which will be consumed by heat. A preferred material for sheet 64 polyethylene. Polyethylene will preferably eventually be consumed by the heat from a fire in the hearth. Layer 62 will then rest directly on sealant 68 to provide an extremely tight thermal seal. Once cured or hardened sealant 68 and layer 62 will not stick together upon raising of the cover assembly. A further advantage of sealant 68 is the prevention of freezing of the lid 42 to the top of the flue opening.

Figure 2:
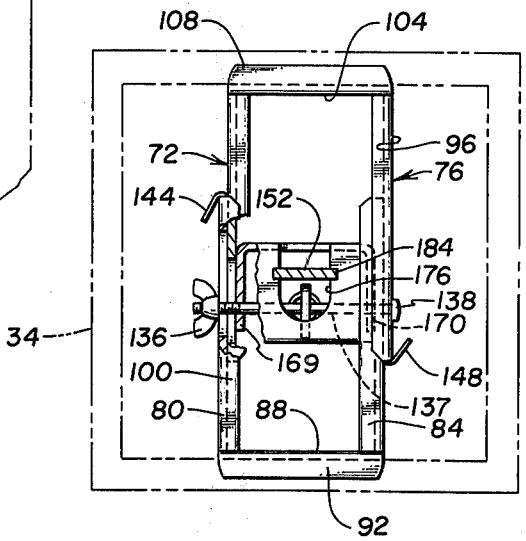
FIG. 2 is a plan view taken along lines 2—2 of FIG. 1 illustrating the adjustable flue bracket.

Upper mounting assembly 18, depicted in FIGS. 1 and 2, includes telescoping slide members 72 and 76. Slide member 72 has side walls 80 and 84 and end plate 88, the latter having an upper lip 92. Similarly, slide member 76 has side walls 96 and 100 and end plate 104, the latter having an upper lip 108. Side walls 80 and 100 are provided with opposing, matching, longitudinally extending slots 112 and 116, respectively. Side walls 84 and 96 are similarly provided with slot 120 (not shown) and slot 124. Upper mounting assembly 18 is placed inside the opening of the chimney, and slide members 72 and 76 extended in opposing directions until the flue opening is completely spanned and lips 92 and 108 are positioned over opposing edges of the flue opening.

After slide members 72 and 76 are extended into place, they are locked into position. Initial locking is provided by means described hereinafter. Final locking is provided by tightening three wing nuts on their respective bolts. Wing nut 136 is mounted on bolt 137 which extends from slot 116 through the side walls of the guide bracket described below and then through slot 124. Bolt 137 has an enlarged head 138 which maintains bolt 137 in slot 124. Wing nut 139 is mounted on head bolt 140 which passes through slots 112. A third head bolt (not shown) passes through slots 120 and the adjacent side wall of the guide bracket and is fitted with a wing nut (not shown).

Figure 3:
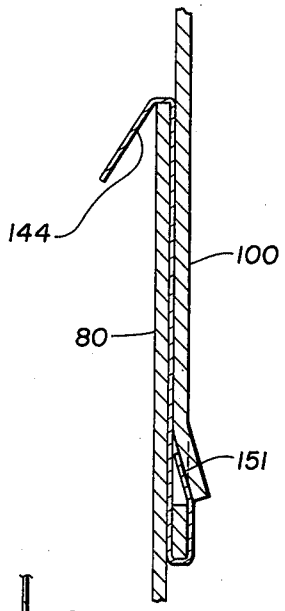
FIG. 3 is a magnified detail of walls 80–100 of the adjustable flue bracket of FIG. 2.

Slide members 72 and 76 are equipped with identical tabs 144 and 148, respectively. The tabs are elongated, bendable, thin metal strips; tab 144 being attached to side wall 100 and tab 148 being attached to side wall 84. The attachment of tab 144 to side wall 100 is shown in detail in FIG. 3. Side wall 100 is provided with a slot 151 into which is fitted one end of tab 144. Tab 144 is then bent around the end of side wall 100 and passes between side wall 100 and side wall 80 and extends beyond the end of side wall 80. Tab 148 is similarly mounted with respect to side walls 84 and 96. The purpose of tabs 144 and 148 is to provide a quick locking mechanism for the slide members 72 and 76 once they have been extended the proper distance so that lips 92 and 108 rest on opposing edges of the chimney top. Tabs 144 and 148 are bent backwards against the outer side walls 80 and 96 to restrain the slide members 72 and 76 in their extended positions. The purpose for tabs 144 and 148 will be explained hereinafter in conjunction with the description of the lift assembly.

The lift assembly 22, depicted in FIGS. 1, 4, 5, and 6, includes a vertical bracket 152 fixedly mounted to cover assembly 14 by a pair of bolts 156, one of which is shown in FIG. 4. Mounted within upper mounting assembly 18, and held in place therein by the wing nut and bolt combinations described above is vertical guide bracket 160. Guide bracket 160 includes a base plate 164 and an opposing top plate 168, and side walls 169 and 170. Base plate 164 and top plate 168 are provided with opposing openings 172 and 176 each having rearward opposing lateral notches 180 and 184 through which passes vertical bracket 152. Bracket 152 terminates at the lower end in flange 186 having an elongated slot 188. Passing through elongated slot 188 is keeper member 192 having an upper loop section 196, a lower loop section 200, and projections 204 extending crosswise of loop section 200 and slot 188. It is highly desirable that slot 188 be at least 3-6 cm. in length to allow member 192 to move therein without binding. This movement of member 192 occurs as the angle of the wire cable hereinafter described changes in the course of closing and opening the lid 42. Attached to loop section 196 is a large tension spring 208 which passes through opening 172 of plate 164. The opposing end of spring 208 is attached to cam lock member 212 pivotally mounted on bolt 137. Spring 208 is upwardly biased in the direction of cover assembly 14, thus urging the cover assembly into the open position as shown in FIG. 1. Cam lock member 212 has a notched edge 216. Due to the tension provided by spring 208, cam lock member 212 is held in a nonlocking position as shown in FIG. 4. A wire spring 220 urges cam lock member 212 to pivot towards vertical bracket 152 as shown by arrow 224. This action of wire spring 220 is overcome by the stronger force exerted by tension spring 208. However, in the event tension spring 208 breaks or otherwise malfunctions while cover assembly 14 is open, such that cover assembly 14 would pass into its covering position, wire spring 220 causes cam lock member 212 to pivot thereby engaging bracket 152 with the notched edge 216. Spring 220 is preferably of a very high temperature-resistant metal, even higher resistant than spring 208. Thus, cam lock member 212 serves an important failsafe function in preventing the cover assembly 14 from closing unintentionally should spring 208 malfunction.

Figure 6:
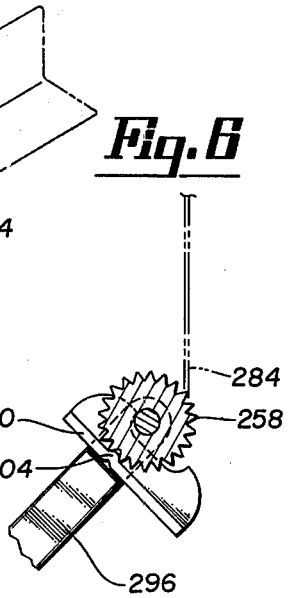
FIG. 6 is a sectional view taken along line 6—6 of FIG. 5.
Figure 5:
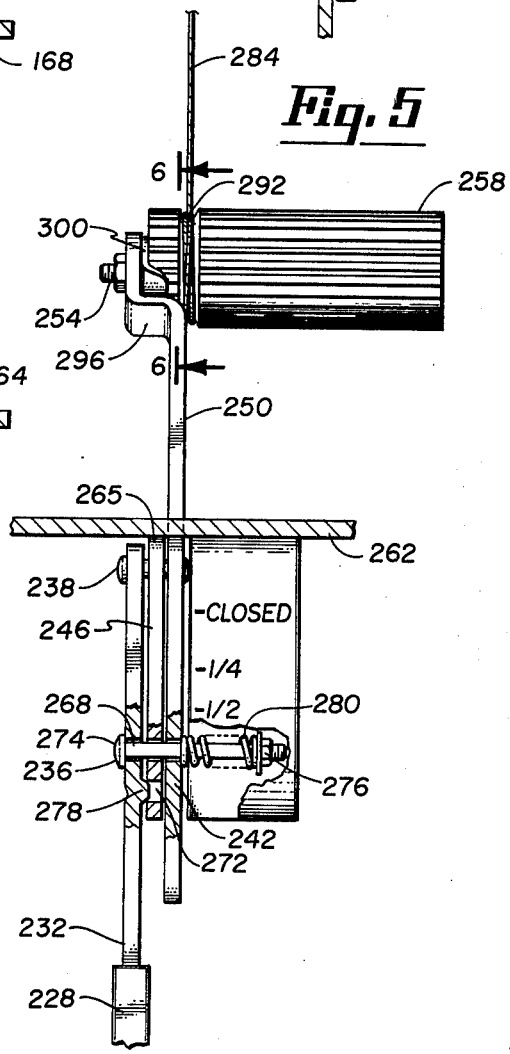
FIG. 5 is an elevational detail of the damper regulating mechanism.

Actuating assembly 26, depicted in FIGS. 1, 5, and 6, includes removable handle 228 which fits on a lower arm 232. Lower arm 232 is attached at points 236 and 238 to a first section 242 of upper angle arm 246. The second section 250 of upper arm 246 is mounted at 254 to ratchet spool 258. Depending from mounting plate 262 is guide member 265 having an arcuate slot 268 and a series of arcuately disposed square holes 272. Extending through arm 232, slot 268, and the first section 242 of arm 246 at point 236 is a threaded bolt 274 fitted with a nut 276. Between nut 276 and arm 246 is positioned a spring 280 which urges the first section 242 of arm 246 toward lower arm 232. Located below bolt 274 on arm 232 is a projection or button 278 which extends into one of the square holes 272. As best seen from FIG. 5, to move the button 278 from one square hole to another (and consequently alter the position of the cover assembly relative to the top edge of the chimney), handle 228 is pushed outwardly away from guide member 265 thereby overcoming the force spring 280 to clear button 278, and then handle 228 is moved so that button 278 is adjacent the desired square hole 272. The outward force on handle 228 is then relaxed and the force of spring 280 allows the button 278 to enter the desired square hole where it is retained until further movement is desired.

Extending from the lower loop section 200 of keeper member 192 is a length of wire cable 284. Wire cable 284 passes through a hole located in the circumferential depression 292 of ratchet spool 258. Ratchet spool 258 is mounted for rotation on the end of second section 250 of arm 246. Second section 250 has a bend 296 located a distance slightly greater from the end than the radius of spool 258. Fitted between the second section 256 and spool 258 and cradled in the bend 296 is a curved pawl member 300 having a nub 304 which engages the teeth of ratchet spool 258. The configuration of nub 304 is such that ratchet spool 258 may be rotated manually or mechanically in a clockwise direction to wind wire cable 284 onto ratchet spool 258, thus adjusting the cable to the proper length for the particular chimney.

Hearth mounting assembly 30, shown in FIG. 1, includes mounting plate 262 having a series of aligned holes 308 along opposing edges for accommodation to various size hearth angles (lintels) 38. Bracket 312 is bolted at flange 316 to mounting plate 262. Lip 320 of bracket 312 fits over the top edge of hearth angle 38. Mounted at the forward end of plate 262 is bracket 324 which hooks on to the forward edge of hearth angle 38.

Installation of the damper unit is readily accomplished by the do-it-yourselfer without the need for special tools. If the chimney has an existing conventional damper, it is either removed or fastened with wire into a permanent full open position. The hearth mounting assembly 30 and actuating assembly 26 (except for cable 284) are preassembled and mounted on the hearth angle 38. At the top of the chimney, and preassembled cover assembly 14, upper mounting assembly 18, lift assembly 22, and wire cable 284 of the actuating assembly 26 are mounted as follows. The wire cable 284 is lowered down the flue and all wing nuts loosened. Sealant 68 is applied under lips 92 and 108. A strip of sealant is also preferably applied across the front of end plates 88 and 104 to bond the plates to the inside of the flue. The tile at the top of the chimney should be cleaned to remove grime or loose material which will inhibit adhesion of the sealant 68 to the flue top. The slide members 72 and 76 are then spread across the narrow width of the flue opening until end plates 88 and 104 are flush with opposing inside walls of the flue. Tabs 144 and 148 are then bent to provide temporary locking of slide members 72 and 78. Tabs 144 and 148 lock the telescoping slide members 72 and 76 only. The guide bracket 160 can then be slidably centrally positioned while the slide members 72 and 76 are held in place. After centering the guide bracket 160, the wing nuts are tightened.

With the handle 288 in the closed position, cable 284 is passed through the hole in depression 292 of ratchet spool 258, and slack in cable 284 taken up. Then ratchet spol 258 is rotated clockwise to lower the cover assembly 14 onto the top of the flue opening.

Then, the handle 228 is moved as noted above so that button 278 is located in the square hole 272 corresponding to the fully open position of the cover assembly 14. The sealant 68 is applied to the edge of the flue opening in a continuous bead sufficiently thick to ensure full and continuous contact between sheet 64 and the lowered cover assembly. Handle 228 is then shifted to the closed position lowering the cover assembly 14 onto the uncured sealant. The cover assembly 14 is retained in this closed position for as long as is necessary to insure proper curing of the sealant, generally for at least seven days.

The flue damper of this assembly provides numerous improvements to hitherto available flue dampers, including that described in the above-noted Ser. No. 97,766. One such feature is the cam lock member 212 which serves as a failsafe feature preventing the open closure cap from closing in the event spring 208 breaks or otherwise malfunctions. This, coupled with the fact that spring 208 normally biases the closure cap in an open position, effectively prevents the closure cap from being in the closed position should the assembly malfunction in any respect. Thus, for example, should cable 284 break, spring 208 would urge the closure cap open. Another noteworthy feature is the telescoping slide members 72 and 76, which allow the mounting member to stably span openings of all sizes. Tab members 144 and 148 provide the means for quickly restraining the slide members 72 and 76 from further movement once the slide members have been extended into abuttment with the inside walls of the flue. The ratchet spool 258 and associated pawl member 300 allows the cable adjustment to be made in the closed position thereby obtaining an immediate accurate setting without the need for trial and error.

What is claimed is:

1. A flue damper assembly comprising;

a. mounting means adjustably positionable across a flue opening;

b. a downwardly extending lifting element arranged for sliding vertical movement;

c. closure cap means of a size sufficient to cover said flue opening, said closure cap means being mounting on the upper end of said lifting element;

d. biasing means operatively associated with said lifting element and normally urging said closure cap means into an open position;

e. hearth located control means operatively connected to said biasing means for remotely controlling the position of said closure cap means relative to said flue opening, said control means including cable means operatively attached at one end to said biasing means and at the other end to spool means, said spool means being rotatably mounted on a handle means having a hand graspable section, restraining means releasably engageable with said spool means for controlling the direction of rotation of said spool means, and positioning means providing a plurality of preselected positions for said handle means corresponding to positions of said closure cap relative to said flue opening.

2. The apparatus of claim 1 and braking means operable in response to a malfunction of the biasing means to stop the lifting element from dropping to a closed position.

3. The assembly of claim 1 wherein said biasing means is attached to said braking means, said biasing means operatively exerting a force on said braking means maintaining said braking means out of engagement with said lifting element, said braking means being adapted to brakingly engage said lifting element when said force is removed.

4. The assembly of claim 1 further comprising tab means mounted on said sections, said tab means being bendable between a stop position wherein relative movement of said section is restrained and a free position wherein relative movement of said sections is unrestrained.

5. The assembly of claim 1 wherein said spool means is a ratchet and said restraining is a pawl.

6. The assembly of claim 1 wherein said hand-graspable section is a detachable section of said handle means.

7. The assembly of claim 5 wherein said ratchet has a circumferential groove for receiving windings of said cable means.

8. The assembly of claim 1 wherein said lift element comprises a vertical section terminating at at least one end in a horizontal section, said horizontal section having an elongated aperture, linking means connecting said biasing element to said cable means, said linking means being nonbindingably slidable in a first direction in said aperture when the position of said closure cap is moved relative to said flue opening.

9. The apparatus of claim 1 in which the closure cap includes a weather-resistant upper surface and a release undersurface.

10. In combination with a flue closure, remotely positioned control means for operatively engaging a flue closure cap comprising, in combination, cable means operatively attached at one end to a cap positioning control means remotely disposed adjacent the flue opening of a stack, and including spool means at the other end thereof, said spool means being rotatably mounted on handle means having a hand graspable section, restraining means releasably engageable with said spool means for controlling the direction of rotation of said spool means, and positioning means providing a plurality of preselected positions for said handle means corresponding to positions of a closure cap relative to said flue opening.

* * * * *